US009951983B2

(12) United States Patent
Kimura et al.

(10) Patent No.: US 9,951,983 B2
(45) Date of Patent: Apr. 24, 2018

(54) AIR CONDITIONER

(71) Applicant: FUJITSU GENERAL LIMITED, Kanagawa (JP)

(72) Inventors: Takashi Kimura, Kanagawa (JP); Kuniko Hayashi, Wakayama (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 244 days.

(21) Appl. No.: 15/021,179

(22) PCT Filed: Jan. 22, 2014

(86) PCT No.: PCT/JP2014/051165
§ 371 (c)(1),
(2) Date: Mar. 10, 2016

(87) PCT Pub. No.: WO2015/037251
PCT Pub. Date: Mar. 19, 2015

(65) Prior Publication Data

US 2016/0223236 A1 Aug. 4, 2016

(30) Foreign Application Priority Data

Sep. 12, 2013 (JP) ..... 2013-189604

(51) Int. Cl.
*F25D 21/06* (2006.01)
*F25B 47/02* (2006.01)
(Continued)

(52) U.S. Cl.
CPC ..... *F25B 47/025* (2013.01); *F24F 3/065* (2013.01); *F24F 11/0076* (2013.01);
(Continued)

(58) Field of Classification Search
CPC ..... F24F 11/0076; F24F 2011/0063; F24F 2011/0089; F24F 3/065; F25B 2600/025; F25B 2700/00; F25B 47/025; F25B 49/02
(Continued)

(56) References Cited

U.S. PATENT DOCUMENTS 4,151,723 A * 5/1979 Gardner ..... F25B 5/02 62/155
4,604,872 A * 8/1986 Miyazaki ..... F25B 47/025 62/156
(Continued)

FOREIGN PATENT DOCUMENTS

EP 2551614 A2 1/2013
JP 60080046 A * 5/1985 ..... F25D 21/002
(Continued)

OTHER PUBLICATIONS

Extended European Search Report dated Mar. 30, 2017 for the corresponding European Patent Application No. 14844181.9.
(Continued)

*Primary Examiner* — Henry Crenshaw
(74) *Attorney, Agent, or Firm* — Rankin, Hill & Clark LLP

(57) ABSTRACT

An outdoor unit control unit 200 has a defrosting operation condition table 300*a* that defines an activation rotational speed Cr in accordance with a total sum of flow rate coefficients Cva that is a total sum of flow rate coefficients Cv representing capacities of indoor expansion valves 52*a* to 52*c*. The outdoor unit control unit 200 calculates the total sum of the flow rate coefficients Cva by adding the flow rate coefficient Cv of each of the indoor expansion valves 52*a* to 52*c*, and refers to the defrosting operation condition table 300*a*, so as to determine the activation rotational speed Cr. Then, the outdoor unit control unit 200 activates a compressor 21 at the determined activation rotational speed Cr when
(Continued)

starting a defrosting operation, maintains this activation rotational speed Cr for a predetermined time from the start of the defrosting operation, and drives the compressor 21.

4 Claims, 4 Drawing Sheets

(51) Int. Cl.
*F24F 3/06* (2006.01)
*F24F 11/00* (2018.01)
*F25B 49/02* (2006.01)

(52) U.S. Cl.
CPC ..... *F25B 49/02* (2013.01); *F24F 2011/0063* (2013.01); *F24F 2011/0083* (2013.01); *F24F 2011/0089* (2013.01); *F25B 2313/006* (2013.01); *F25B 2313/0233* (2013.01); *F25B 2313/0293* (2013.01); *F25B 2313/0294* (2013.01); *F25B 2313/0314* (2013.01); *F25B 2313/0315* (2013.01); *F25B 2600/025* (2013.01); *F25B 2700/00* (2013.01); *F25B 2700/1931* (2013.01); *F25B 2700/1933* (2013.01); *F25B 2700/21151* (2013.01); *F25B 2700/21152* (2013.01)

(58) Field of Classification Search
USPC ..... 62/155
See application file for complete search history.

(56) References Cited

U.S. PATENT DOCUMENTS 4,901,534 A * 2/1990 Nakatsuno ..... F25B 47/022 62/155
5,092,134 A * 3/1992 Tagashira ..... F25B 1/00 62/155
5,832,735 A * 11/1998 Matsumoto ..... F24F 11/02 62/151
6,047,554 A * 4/2000 Choi ..... F25D 21/006 62/154
6,286,326 B1 * 9/2001 Kopko ..... F25D 17/065 62/179
2002/0116941 A1 * 8/2002 Kim ..... F04B 35/04 62/211
2009/0266093 A1 * 10/2009 Aoki ..... F25B 47/025 62/155
2010/0218528 A1 * 9/2010 Yakumaru ..... F25B 47/022 62/234
2011/0197605 A1 * 8/2011 Suzuki ..... B60H 1/00335 62/140
2014/0311172 A1 * 10/2014 Iwasaki ..... F24F 1/06 62/151

FOREIGN PATENT DOCUMENTS

JP 63259342 A2 10/1988
JP 4136669 A2 5/1992
JP 7027453 A2 1/1995
JP 2003240310 A2 8/2003
JP 2009228928 A * 10/2009
JP 2009228928 A2 10/2009
JP 2010139205 A2 6/2010

OTHER PUBLICATIONS

International Search Report dated Apr. 28, 2014 filed in PCT/JP2014/051165.
Written Opinion of the International Searching Authority dated Apr. 17, 2014 filed in PCT/JP2014/051165 and its English translation thereof.

* cited by examiner

FIG. 2

300a DEFROSTING OPERATION CONDITION TABLE

| Cva | Cr (rps) | Tm (min) |
|---|---|---|
| Cva < A | 60 | 90 |
| Cva ≥ A | 90 | 180 |

Cva: TOTAL SUM OF FLOW RATE COEFFICIENT Cv OF INDOOR EXPANSION VALVE
Cr: ACTIVATION ROTATIONAL SPEED (rps)
Tm: DEFROSTING OPERATION INTERVAL (min)

FIG. 4

300b DEFROSTING OPERATION CONDITION TABLE

| Cva | Lr (m) | Cr (rps) | Tm (min) |
|---|---|---|---|
| Cva < A | Lr ≥ B | 50 | 70 |
| | Lr < B | 60 | 90 |
| Cva ≥ A | Lr ≥ B | 80 | 120 |
| | Lr < B | 90 | 180 |

Cva: TOTAL SUM OF FLOW RATE COEFFICIENT Cv OF INDOOR EXPANSION VALVE

Lr: REFRIGERANT PIPE LENGTH FOR CONNECTING INDOOR UNIT-OUTDOOR UNIT (m)

Cr: ACTIVATION ROTATIONAL SPEED (rps)

Tm: DEFROSTING OPERATION INTERVAL (min)

AIR CONDITIONER

TECHNICAL FIELD

The present invention relates to an air conditioner in which at least one outdoor unit and at least one indoor unit are mutually coupled by plural refrigerant pipes.

BACKGROUND ART

An air conditioner in which at least one outdoor unit and at least one indoor unit are mutually coupled by plural refrigerant pipes has been suggested. In the case where a temperature of an outdoor heat exchanger becomes equal to or less than 0° C. when this air conditioner performs a heating operation, the outdoor heat exchanger may be frosted. When the outdoor heat exchanger is frosted, ventilation to the outdoor heat exchanger is inhibited by the frost, and thus heat exchange efficiency in the outdoor heat exchanger may be degraded. Thus, when frosting occurs to the outdoor heat exchanger, a defrosting operation has to be performed to defrost the outdoor heat exchanger.

For example, in an air conditioner described in Patent Literature 1, an outdoor unit that includes a compressor, a four-way valve, an outdoor heat exchanger, and an outdoor fan is coupled to two indoor units, each of which includes an indoor heat exchanger, an indoor expansion valve as a flow rate adjustment valve, and an indoor fan, via a gas refrigerant pipe and a liquid refrigerant pipe. In the case where, in this air conditioner, a defrosting operation is performed during a heating operation, the rotation of the outdoor fan and the rotation of the indoor fan are stopped. In conjunction with this, the compressor is stopped once, the four-way valve is switched such that the outdoor heat exchanger is shifted from a state of functioning as an evaporator to a state of functioning as a condenser, and the compressor is activated again. When the outdoor heat exchanger functions as the condenser, a high-temperature refrigerant discharged from the compressor flows into the outdoor heat exchanger and melts frost formed on the outdoor heat exchanger. Thus, the outdoor heat exchanger can be defrosted.

CITATION LIST

Patent Literature

PATENT LITERATURE 1: JP-A-2009-228928

SUMMARY OF THE INVENTION

Problems to be Solved by the Invention

When the defrosting operation is performed, a rotational speed of the compressor is preferably increased to be as high as possible. It is because, when the defrosting operation is performed by increasing the rotational speed of the compressor, an amount of the high-temperature refrigerant that is discharged from the compressor and flows into the outdoor heat exchanger is increased, a defrosting operation time is thus shortened, and the heating operation can be restored at an early stage. For this reason, the compressor is usually activated at a predetermined high rotational speed (for example, 90 rps. Hereinafter, it is described as an activation rotational speed) at a start of the defrosting operation.

As described above, in the case where the activation rotational speed of the compressor is increased at the start of the defrosting operation, when pull-down (a phenomenon that suction pressure is abruptly reduced during the activation of the compressor), which will be described below, or a reduction in a refrigerant circulation amount due to a rated capacity of the indoor unit occurs, the suction pressure of the compressor may be significantly reduced and fall below a performance lower limit value of the compressor.

First, the pull-down that occurs at the start of the defrosting operation will be described. As described above, when the defrosting operation is performed, the compressor is stopped once, the four-way valve is switched, and then the compressor is activated again. When the four-way valve is switched, one port on the indoor heat exchanger side of the indoor expansion valve that is coupled to a discharge side of the compressor during the heating operation is coupled to a suction side of the compressor, and a pressure difference from the other port of the indoor expansion valve is reduced.

The pressure difference between both of the ports of the indoor expansion valve is increased as time elapses from the activation of the compressor. The refrigerant does not flow into the gas refrigerant pipe from the indoor unit until the pressure difference becomes equal to or more than a predetermined value. Accordingly, during the activation of the compressor, the so-called pull-down, in which the refrigerant that is accumulated at a position near the suction side of the compressor in the gas refrigerant pipe is suctioned, an amount of the refrigerant accumulated in the gas refrigerant pipe is then temporarily reduced, and the suction pressure of the compressor is abruptly reduced, occurs. It should be noted that a degree of a reduction in the suction pressure by the pull-down is increased as the activation rotational speed of the compressor is increased.

Next, the reduction in the refrigerant circulation amount due to the rated capacity of the indoor unit will be described. During the defrosting operation, the outdoor heat exchanger functions as the condenser. Accordingly, the high-temperature refrigerant that is discharged from the compressor flows into the outdoor heat exchanger and melts the generated frost. An amount of frost formation on the outdoor heat exchanger is an amount of the frost formation that corresponds to size of the outdoor heat exchanger. As the size of the outdoor heat exchanger is increased, the amount of the frost formation is also increased. Thus, in the case where the outdoor heat exchanger is large, the further large amount of the high-temperature refrigerant has to flow through the outdoor heat exchanger in comparison with a case where the outdoor heat exchanger is small.

Meanwhile, the indoor heat exchanger that functions as the evaporator during the defrosting operation is set in size that corresponds to the rated capacity of the indoor unit, and is provided with an indoor expansion valve having a capacity that corresponds to the size of the indoor heat exchanger. Here, the capacity of the indoor expansion valve is an amount of the refrigerant that passes through the indoor expansion valve per unit time when the indoor expansion valve is fully opened. The indoor expansion valve with the smaller capacity is used as the size of the indoor heat exchanger is reduced. Thus, in the case where the indoor heat exchanger is small, the indoor expansion valve with the small capacity is used in comparison with a case where the indoor heat exchanger is large. Thus, the amount of the refrigerant that passes through the indoor expansion valve, that is, the amount of the refrigerant that flows out from the indoor unit to the gas refrigerant pipe is reduced. That is, the refrigerant is accumulated in the outdoor heat exchanger and a liquid refrigerant pipe, and a refrigerant circulation amount in the air conditioner is reduced. As the refrigerant circulation amount is reduced, the degree of the reduction in the suction pressure is increased.

As described above, in a state that the suction pressure is reduced by the reduction in the refrigerant circulation amount, which is caused by the small capacity of the indoor expansion valve, at the start of the defrosting operation, when the compressor is activated with the activation rotational speed of the compressor being increased (for example, 90 rps) in order to start the defrosting operation, the suction pressure may be further reduced by the pull-down, which occurs during the activation of the compressor, and fall below the performance lower limit value. Then, when the suction pressure falls below the performance lower limit value, the compressor may be damaged. Alternatively, low-pressure protection control for stopping the compressor 21 to prevent damage to the compressor 21 is executed. Thus, the defrosting operation time is extended, and restoration of the heating operation is delayed.

The present invention solves the above-described problem. An object of the present invention is to provide an air conditioner that prevents damage to a compressor and a delay in restoration of a heating operation by executing defrosting operation control that corresponds to capacity of an indoor expansion valve, that is, rated capacity of an indoor unit.

Solutions to the Problems

In order to solve the above problem, an air conditioner of the present invention has: at least one outdoor unit having a compressor, a flow passage switching unit, an outdoor heat exchanger, and an outdoor unit controller; at least one indoor unit having an indoor heat exchanger and a flow rate adjustment valve; at least one liquid pipe and at least one gas pipe for coupling the outdoor unit and the indoor unit. The outdoor unit controller drives the compressor at an activation rotational speed as a predetermined value for a predetermined time from a start of a defrosting operation. Plural values are defined as the activation rotational speed in accordance with a total sum of a capacity of the flow rate adjustment valve.

In addition, plural values are defined as the activation rotational speed of the compressor at the start of the defrosting operation in accordance with the total sum of the capacity of the flow rate adjustment valve and a refrigerant pipe length as lengths of the liquid pipe and the gas pipe.

Advantageous Effects of the Invention

According to the air conditioner of the present invention that is configured as described as above, the compressor is driven at the activation rotational speed in accordance with the total sum of the capacity of the flow rate adjustment valve or at the activation rotational speed in accordance with the total sum of the capacity of the flow rate adjustment valve and the refrigerant pipe length for the predetermined time from the start of the defrosting operation. Accordingly, even in the case where a refrigerant circulation amount at the start of the defrosting operation is reduced by the small total sum of the capacity of the flow rate adjustment valve, the suction pressure can be prevented from being significantly reduced and falling below performance lower limit pressure of the compressor. Thus, damage to the compressor can be prevented. In addition, it is possible to prevent a case where the suction pressure falls below the performance lower limit suction pressure of the compressor and low-pressure protection control is executed. Therefore, a case where the defrosting operation is interrupted by the low-pressure protection control, a defrosting operation time is extended, and restoration of a heating operation is delayed does not occur.

BRIEF DESCRIPTION OF THE DRAWINGS

FIG. 2 is a defrosting operation condition table in the embodiment of the invention.

FIG. 4 is a defrosting operation condition table in a second embodiment of the present invention.

DESCRIPTION OF EMBODIMENTS

Figure 1:
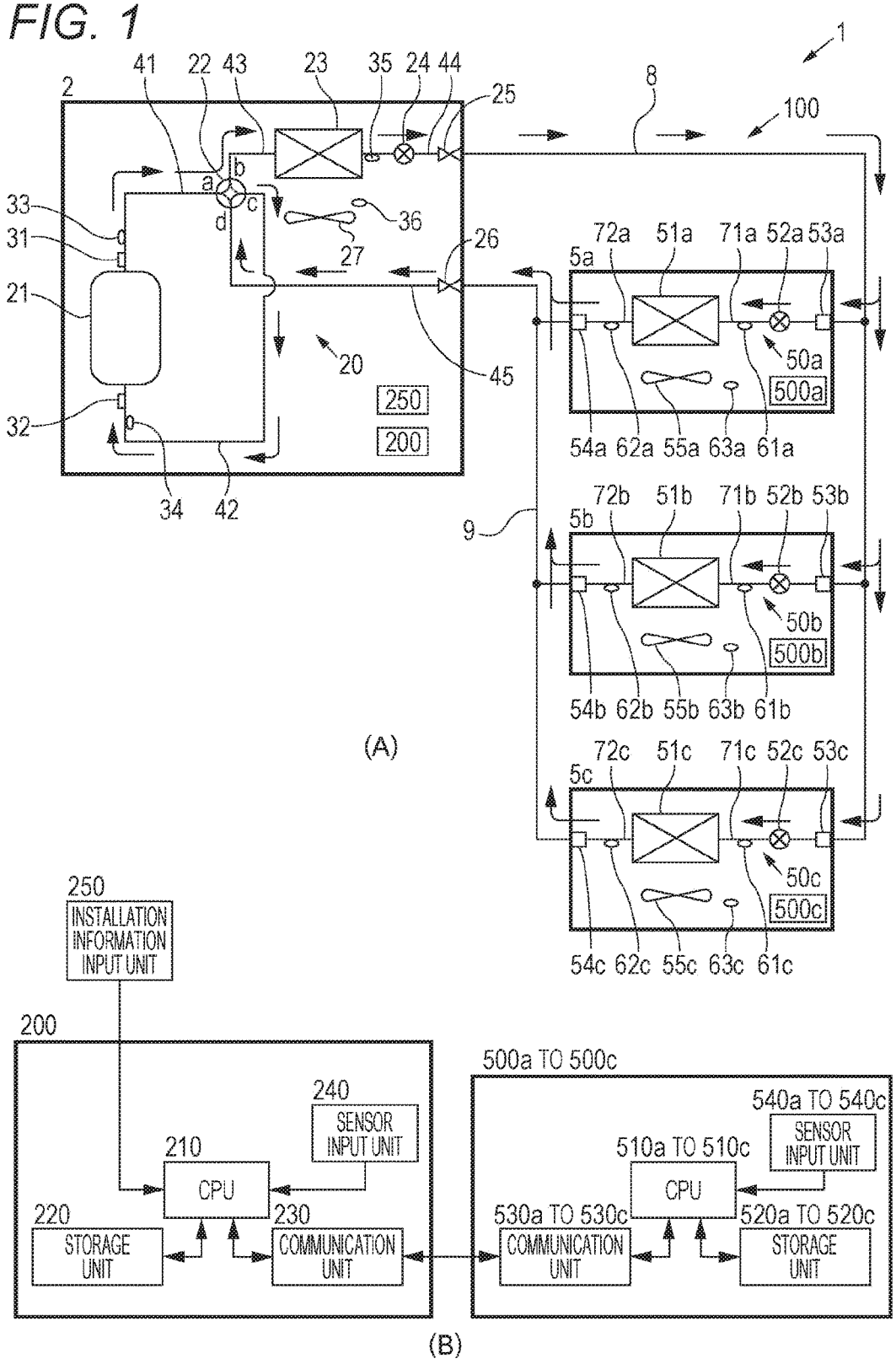
FIG. 1 is an explanatory view of an air conditioner in an embodiment of the present invention, in which (A) is a refrigerant circuit diagram, and (B) is a block diagram of an outdoor unit controller and an indoor unit controller.

A detailed description will hereinafter be made on embodiments of the present invention based on the accompanying drawings. A description will be made by raising an example of an air conditioner in which three indoor units are coupled in parallel to one outdoor unit and in which a cooling operation or a heating operation can simultaneously be performed by all of the indoor units as the embodiments. It should be noted that the present invention is not limited to the following embodiments, but various modifications can be made thereto within a scope of the gist of the present invention.

EXAMPLE 1

As depicted in FIG. 1(A), an air conditioner 1 of this example includes: one outdoor unit 2 that is installed outdoors; and three indoor units 5*a* to 5*c* that are coupled in parallel to the outdoor unit 2 via a liquid pipe 8 and a gas pipe 9. In detail, one end of the liquid pipe 8 is coupled to a closing valve 25 of the outdoor unit 2, and the other end thereof is branched and respectively coupled to liquid pipe coupling portions 53*a* to 53*c* of the indoor units 5*a* to 5*c*. In addition, one end of the gas pipe 9 is coupled to a closing valve 26 of the outdoor unit 2, and the other end thereof is branched and respectively coupled to gas pipe coupling portions 54*a* to 54*c* of the indoor units 5*a* to 5*c*. Thus, a refrigerant circuit 100 of the air conditioner 1 is configured.

First, the outdoor unit 2 will be described. The outdoor unit 2 includes a compressor 21, a four-way valve 22 as a flow passage switching unit, an outdoor heat exchanger 23, an outdoor expansion valve 24, the closing valve 25, to which the one end of the liquid pipe 8 is coupled, the closing valve 26, to which the one end of the gas pipe 9 is coupled, and an outdoor fan 27. Then, each of devices other than the outdoor fan 27 is mutually coupled by each refrigerant pipe, which will be described in detail below, and constitutes an outdoor unit refrigerant circuit 20 for constituting a part of the refrigerant circuit 100.

The compressor 21 is a variable-capacity-type compressor that can change operation capacity by being driven by a motor, not depicted, whose rotational speed is controlled by an inverter. A refrigerant discharge side of the compressor 21 is coupled to a port a of the four-way valve 22, which will be described below, via a discharge pipe 41. In addition, a refrigerant suction side of the compressor 21 is coupled to a port c of the four-way valve 22, which will be described below, via an intake pipe 42.

The four-way valve 22 is a valve for switching a flow direction of the refrigerant and includes four ports of a, b, c, and d. As described above, the port a is coupled to the refrigerant discharge side of the compressor 21 via the discharge pipe 41. A port b is coupled to one of refrigerant entry/exit openings of the outdoor heat exchanger 23 via a refrigerant pipe 43. As described above, the port c is coupled to the refrigerant suction side of the compressor 21 via the intake pipe 42. A port d is coupled to the closing valve 26 via an outdoor unit gas pipe 45.

The outdoor heat exchanger 23 exchanges heat between the refrigerant and ambient air that is taken into the outdoor unit 2 by rotation of the outdoor fan 27, which will be described below. As described above, one of the refrigerant entry/exit openings of the outdoor heat exchanger 23 is coupled to the port b of the four-way valve 22 via the refrigerant pipe 43, and the other of the refrigerant entry/exit openings is coupled to the closing valve 25 via an outdoor unit liquid pipe 44.

The outdoor expansion valve 24 is provided in the outdoor unit liquid pipe 44. The outdoor expansion valve 24 is an electronic expansion valve, and adjusts an amount of the refrigerant that flows into the outdoor heat exchanger 23 or an amount of the refrigerant that flows out from the outdoor heat exchanger 23 when an opening degree thereof is adjusted.

The outdoor fan 27 is formed of a resin material and arranged in the vicinity of the outdoor heat exchanger 23. The outdoor fan 27 is rotated by an undepicted fan motor so as to take the ambient air into the outdoor unit 2 from an undepicted inlet, and discharges the ambient air that has exchanged heat with the refrigerant in the outdoor heat exchanger 23 to the outside of the outdoor unit 2 from an undepicted outlet.

In addition to the configuration that has been described so far, the outdoor unit 2 is provided with various types of sensors. As depicted in FIG. 1(A), the discharge pipe 41 is provided with: a high-pressure sensor 31 for detecting pressure of the refrigerant that is discharged from the compressor 21; and a discharge temperature sensor 33 for detecting a temperature of the refrigerant that is discharged from the compressor 21. The intake pipe 42 is provided with: a low-pressure sensor 32 for detecting pressure of the refrigerant that is suctioned into the compressor 21; and a suction temperature sensor 34 for detecting a temperature of the refrigerant that is suctioned into the compressor 21.

The outdoor heat exchanger 23 is provided with a heat exchange temperature sensor 35 for detecting frosting during the heating operation or melting of frost during a defrosting operation. In addition, an ambient air temperature sensor 36 for detecting a temperature of the ambient air that flows into the outdoor unit 2, that is, an ambient air temperature is provided near the undepicted inlet of the outdoor unit 2.

The outdoor unit 2 includes an outdoor unit controller 200. The outdoor unit controller 200 is installed on a control board that is housed in an undepicted electric component box of the outdoor unit 2. As depicted in FIG. 1(B), the outdoor unit controller 200 includes a CPU 210, a storage unit 220, a communication unit 230, and a sensor input unit 240.

The storage unit 220 includes a ROM or a RAM, and stores a control program of the outdoor unit 2, detection values that correspond to detection signals from the various sensors, control states of the compressor 21 and the outdoor fan 27, a defrosting operation condition table, which will be described below, and the like. The communication unit 230 is an interface for performing communication among the indoor units 5*a* to 5*c*. The sensor input unit 240 receives detection results of the various sensors in the outdoor unit 2 and outputs the detection results to the CPU 210.

The CPU 210 receives the detection result of each of the sensors in the outdoor unit 2, just as described, via the sensor input unit 240. In addition, the CPU 210 receives control signals, which are transmitted from the indoor units 5*a* to 5*c*, via the communication unit 230. Based on the received detection results and control signals, the CPU 210 executes drive control of the compressor 21 and the outdoor fan 27. Furthermore, based on the received detection results and control signals, the CPU 210 executes switching control of the four-way valve 22. Moreover, based on the received detection results and control signals, the CPU 210 executes opening degree control of the outdoor expansion valve 24.

The outdoor unit 2 includes an installation information input unit 250. The installation information input unit 250 is arranged on a side surface of an undepicted housing of the outdoor unit 2, and can be operated from the outside. Although not depicted, the installation information input unit 250 is formed of a setting button, a determination button, and a display portion. The setting button includes ten keys, for example, and is used to input information on a refrigerant pipe length (lengths of the liquid pipe 8 and the gas pipe 9) and a flow rate coefficient Cv of each of the indoor expansion valves 52*a* to 52*c* which will be described below. The determination button is used to confirm the information that is input by the setting button. The display portion displays various types of the input information, current operation information of the outdoor unit 2, and the like. However, the installation information input unit 250 is not limited to what has been described above. For example, the setting button may be a DIP switch, a dial switch, or the like.

Next, the three indoor units 5*a* to 5*c* will be described. The three indoor units 5*a* to 5*c* respectively include indoor heat exchangers 51*a* to 51*c*, indoor expansion valves 52*a* to 52*c* as a flow rate adjustment valve, the liquid pipe coupling portions 53*a* to 53*c*, to which the branched other ends of the liquid pipe 8 are respectively coupled, the gas pipe coupling portions 54*a* to 54*c*, to which the branched other ends of the gas pipe 9 are respectively coupled, and indoor fans 55*a* to 55*c*. Then, the devices other than the indoor fans 55*a* to 55*c* are mutually coupled by the refrigerant pipes, which will be described in detail below, and constitute indoor unit refrigerant circuits 50*a* to 50*c*, each of which constitutes a part of the refrigerant circuit 100.

It should be noted that, since configurations of the indoor units 5*a* to 5*c* are all the same, only the configuration of the indoor unit 5*a* will be described in the following description, and the indoor units 5*b* and 5*c* will not be described. In addition, in FIG. 1, last letters of the reference signs given to components of the indoor unit 5*a* are changed from a to b and c, and the changed reference signs are given to components of the indoor units 5*b* and 5*c* that correspond to the components of the indoor unit 5*a*.

The indoor heat exchanger 51*a* exchanges heat between the refrigerant and indoor air that is taken into the indoor unit 5*a* from an undepicted inlet by the indoor fan 55*a*, which will be described below. One of refrigerant entry/exit openings of the indoor heat exchanger 51*a* is coupled to the liquid pipe coupling portion 53*a* via an indoor unit liquid pipe 71*a*, and the other of the refrigerant entry/exit openings is coupled to the gas pipe coupling portion 54*a* via an indoor unit gas pipe 72*a*. The indoor heat exchanger 51*a* functions as an evaporator when the indoor unit 5*a* performs the cooling operation, and functions as a condenser when the indoor unit 5*a* performs the heating operation. The indoor heat exchanger 51*a* has a size that corresponds to a rated capacity of the indoor unit 5*a*.

It should be noted that each of the refrigerant pipes is coupled to the liquid pipe coupling portion 53*a* and the gas pipe coupling portion 54*a* by welding, a flare nut, or the like.

The indoor expansion valve 52*a* is provided in the indoor unit liquid pipe 71*a*. The indoor expansion valve 52*a* is an electronic expansion valve having capacity that corresponds to the size of the indoor heat exchanger 51*a*. By adjusting an opening degree thereof, an amount of the refrigerant that flows through the indoor heat exchanger 51*a* can be adjusted. The opening degree of the indoor expansion valve 52*a* is adjusted in accordance with requested cooling capacity in the case where the indoor heat exchanger 51*a* functions as the evaporator, and is adjusted in accordance with requested heating capacity in the case of the indoor heat exchanger 51*a* functions as the condenser. It should be noted that the capacity of the indoor expansion valve 52*a* is an amount of the refrigerant that passes through the indoor expansion valve 52*a* per unit time when the indoor expansion valve 52*a* is fully opened.

The indoor fan 55*a* is formed of a resin material and arranged in the vicinity of the indoor heat exchanger 51*a*. The indoor fan 55*a* is rotated by an undepicted fan motor so as to take the indoor air into the indoor unit 5*a* from the undepicted inlet, and supplies the indoor air that has exchanged heat with the refrigerant in the indoor heat exchanger 51*a* to the inside from an undepicted outlet.

In addition to the configuration that has been described so far, the indoor unit 5*a* is provided with various types of sensors. A liquid-side temperature sensor 61*a* for detecting a temperature of the refrigerant that flows into the indoor heat exchanger 51*a* or of the refrigerant that flows out from the indoor heat exchanger 51*a* is provided between the indoor heat exchanger 51*a* and the indoor expansion valve 52*a* in the indoor unit liquid pipe 71*a*. A gas-side temperature sensor 62*a* for detecting a temperature of the refrigerant that flows out from the indoor heat exchanger 51*a* or of the refrigerant that flows into the indoor heat exchanger 51*a* is provided in the indoor unit gas pipe 72*a*. In addition, an indoor temperature sensor 63*a* for detecting a temperature of the indoor air that flows into the indoor unit 5*a*, that is, an indoor temperature is provided in the vicinity of the undepicted inlet of the indoor unit 5*a*.

The indoor unit 5*a* also includes an indoor unit controller 500*a*. The indoor unit controller 500*a* is installed on a control board that is housed in an undepicted electric component box of the indoor unit 5*a*. As depicted in FIG. 1(B), the indoor unit controller 500*a* includes a CPU 510*a*, a storage unit 520*a*, a communication unit 530*a*, and a sensor input unit 540*a*.

The storage unit 520*a* includes a ROM or a RAM, and stores a control program of the indoor unit 5*a*, detection values that correspond to detection signals from the various sensors, information on setting related to an air conditioning operation by a user, and the like. The communication unit 530*a* is an interface for performing communication between the outdoor unit 2 and the other indoor units 5*b* and 5*c*. The sensor input unit 540*a* receives detection results of the indoor unit 5*a* from the various sensors and outputs the detection results to the CPU 510*a*.

The CPU 510*a* receives the detection result of each of the sensors in the indoor unit 5*a*, just as described, via the sensor input unit 540*a*. In addition, the CPU 510*a* receives a signal that includes operation information, timer operation setting, or the like set by the user through an operation of an undepicted remote controller via an undepicted remote controller light receiving portion. Based on the received detection results and the signal transmitted from the remote controller, the CPU 510*a* executes opening degree control of the indoor expansion valve 52*a* and drive control of the indoor fan 55*a*. In addition, the CPU 510*a* transmits an operation start/stop signal or a control signal that includes the operation information (a set temperature, the indoor temperature, and the like) to the outdoor unit 2 via the communication unit 530*a*.

Next, a description will be made on a flow of the refrigerant and an operation of each component in the refrigerant circuit 100 during the air conditioning operation of the air conditioner 1 in this embodiment by using FIG. 1(A). It should be noted that a case where the indoor units 5*a* to 5*c* perform the cooling operation will be described in the following description, and a detailed description on a case where the heating operation is performed will not be made. Arrows in FIG. 1(A) indicate the flow of the refrigerant during the cooling operation.

As depicted in FIG. 1(A), in the case where the indoor units 5*a* to 5*c* perform the cooling operation, the outdoor unit controller 200 switches the four-way valve 22 to a state indicated by a solid line, that is, such that the port a and the port b of the four-way valve 22 communicate with each other and the port c and the port d communicate with each other. Accordingly, the outdoor heat exchanger 23 functions as the condenser, and the indoor heat exchangers 51*a* to 51*c* function as the evaporators.

The high-pressure refrigerant that is discharged from the compressor 21 flows through the discharge pipe 41, flows into the four-way valve 22, flows out from the four-way valve 22, flows through the refrigerant pipe 43, and flows into the outdoor heat exchanger 23. The refrigerant that flows into the outdoor heat exchanger 23 exchanges heat with the ambient air that is taken into the outdoor unit 2 by the rotation of the outdoor fan 27, and is condensed. The refrigerant that flows out from the outdoor heat exchanger 23 flows through the outdoor unit liquid pipe 44 and flows into the liquid pipe 8 via the outdoor expansion valve 24 and the closing valve 25 that are fully opened.

The refrigerant that flows through the liquid pipe 8, branches, and flows into each of the indoor units 5*a* to 5*c* flows through the indoor unit liquid pipes 71*a* to 71*c*, and is decompressed when passing through the indoor expansion valves 52*a* to 52*c*. Accordingly, the refrigerant becomes the low-pressure refrigerant. The refrigerant that flows into the indoor heat exchangers 51*a* to 51*c* from the indoor unit liquid pipes 71*a* to 71*c* exchanges heat with the indoor air that is taken into the indoor units 5*a* to 5*c* by the rotation of the indoor fans 55*a* to 55*c*, and is evaporated. Just as described, the inside in which the indoor units 5*a* to 5*c* are installed is cooled when the indoor heat exchangers 51*a* to 51*c* function as the evaporators and the indoor air that has exchanged heat with the refrigerant in the indoor heat exchangers 51*a* to 51*c* is blown into the inside from the undepicted outlets.

The refrigerant that flows out from the indoor heat exchangers 51*a* to 51*c* flows through the indoor unit gas pipes 72*a* to 72*c* and flows into the gas pipe 9. The refrigerant that flows through the gas pipe 9 and flows into the outdoor unit 2 via the closing valve 26 flows through the outdoor unit gas pipe 45, the four-way valve 22, and the intake pipe 42, is suctioned into the compressor 21, and is compressed again.

As described above, the cooling operation of the air conditioner 1 is performed when the refrigerant circulates through the refrigerant circuit 100.

It should be noted that, in the case where the indoor units 5*a* to 5*c* perform the heating operation, the outdoor unit controller 200 switches the four-way valve 22 to a state indicated by a broken line, that is, such that the port a and the port d of the four-way valve 22 are communicated with each other and the port b and the port c are communicated with each other. Accordingly, the outdoor heat exchanger 23 functions as the evaporator, and the indoor heat exchangers 51*a* to 51*c* function as the condensers.

In the case where a defrosting operation start condition, which will be described below, is established when the indoor units 5*a* to 5*c* perform the heating operation, the outdoor heat exchanger 23 that functions as the evaporator may be frosted. The defrosting operation start conditions include, for example, a case where a state that a refrigerant temperature detected by the heat exchange temperature sensor 35 is lower by 5° C. or more than the ambient air temperature detected by the ambient air temperature sensor 36 continues for 10 minutes or longer after a lapse of 30 minutes of a heating operation time (a time that the heating operation is continued from a time point at which the air conditioner 1 is activated in the heating operation or a time point at which the heating operation is restored from the defrosting operation), a case where a predetermined time (for example, 180 minutes) has elapsed since the last defrosting operation is terminated, and the like. The defrosting operation start condition indicates that an amount of frost formation on the outdoor heat exchanger 23 is in a level that interferes with the heating capacity.

In the case where the defrosting operation start condition is established, the outdoor unit controller 200 stops the compressor 21 to stop the heating operation. Furthermore, the outdoor unit controller 200 switches the refrigerant circuit 100 to a state during the above-described cooling operation and restarts the compressor 21 at a predetermined rotational speed so as to start the defrosting operation. It should be noted that the outdoor fan 27 and the indoor fans 55*a* to 55*c* are stopped when the defrosting operation is performed. The operation of the refrigerant circuit 100 other than this case is the same as that when the cooling operation is performed. Thus, the detailed description will not be made.

In the case where a defrosting operation termination condition, which will be described below, is established when the air conditioner 1 performs the defrosting operation, it is considered that the frost generated on the outdoor heat exchanger 23 is melted. In the case where the defrosting operation termination condition is established, the outdoor unit controller 200 stops the defrosting operation by stopping the compressor 21, and switches the refrigerant circuit 100 to the state during the heating operation. Thereafter, the outdoor unit controller 200 restarts the heating operation by activating the compressor 21 at a rotational speed that corresponds to the heating capacity required for the indoor units 5*a* to 5*c*. The defrosting operation termination conditions include, for example, whether the temperature of the refrigerant detected by the heat exchange temperature sensor 35 has become at least 10° C., the refrigerant flowing out from the outdoor heat exchanger 23, whether a predetermined time (for example, 10 minutes) has elapsed since the defrosting operation is started, and the like. The defrosting operation termination condition is a condition that it is considered that the frost generated on the outdoor heat exchanger 23 has been melted.

Figure 3:
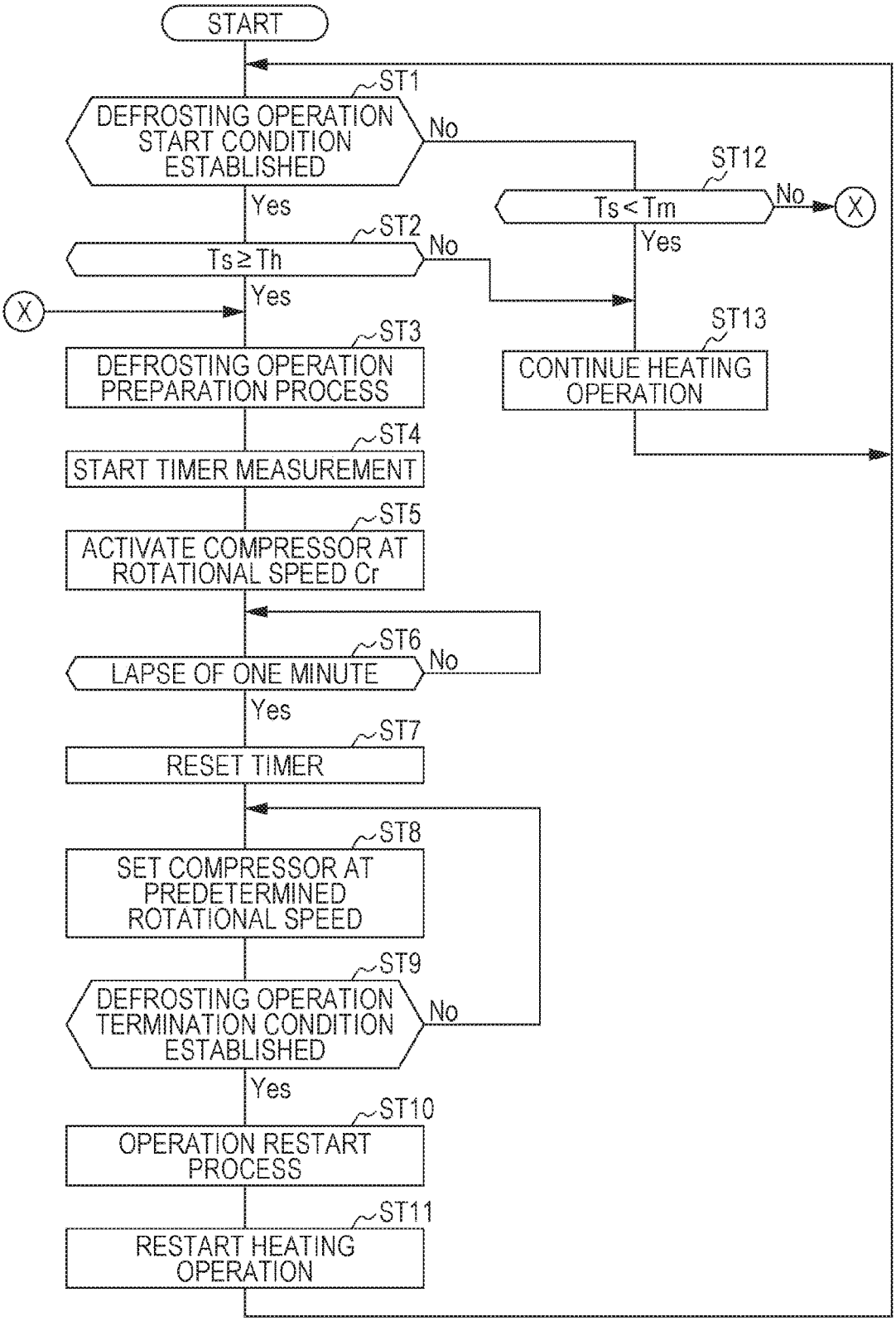
FIG. 3 is a flowchart for explaining a process during a defrosting operation in the embodiment of the present invention.

Next, a description will be made on an operation, an action, and an effect of the refrigerant circuit according to the present invention in the air conditioner 1 of this embodiment by using FIGS. 1 to 3.

The storage unit 220 that is provided in the outdoor unit control means 200 of the outdoor unit 2 stores a defrosting operation condition table 300*a* depicted in FIG. 2 in advance. This defrosting operation condition table 300*a* defines an activation rotational speed Cr (unit: rps) of the compressor 21 and a defrosting operation interval Tm (unit: min) at a time that the air conditioner 1 starts the defrosting operation in accordance with a total sum of flow rate coefficients Cva that is a total sum of flow rate coefficients Cv of the indoor expansion valves 52*a* to 52*c*.

Here, the flow rate coefficients Cv of the indoor expansion valves 52*a* to 52*c* respectively represent the capacities of the indoor expansion valves 52*a* to 52*c* and can represent the capacity of each of the indoor expansion valves 52*a* to 52*c* regardless of a difference in physical property such as a difference in structure or dimension of the indoor expansion valves 52*a* to 52*c*, a pressure difference between both of the ports of each of the indoor expansion valves 52*a* to 52*c*, and the temperature, viscosity, specific gravity, and the like of the refrigerant flowing through the refrigerant circuit 100. The flow rate coefficient Cv is defined by using the specific gravity of the refrigerant, the flow rate of the refrigerant flowing through each of the indoor expansion valves 52*a* to 52*c* per unit time, and the pressure of both of the ports of each of the indoor expansion valves 52*a* to 52*c*.

More specifically, as depicted in FIG. 2, in the case where the total sum of the flow rate coefficients Cva is lower than a predetermined threshold A (for example, 0.4), the activation rotational speed Cr is set at 60 rps, and the defrosting operation interval Tm is set for 90 min. In addition, in the case where the total sum of the flow rate coefficients Cva is equal to or more than the threshold A, the activation rotational speed Cr is set at 90 rps, and the defrosting operation interval Tm is set for 180 min. It should be noted that the threshold A, the activation rotational speed Cr, and the defrosting operation interval Tm, which are shown in FIG. 2, are numerical values that are defined in advance by a test or the like, and numerical values that are inherent to the air conditioner 1.

First, a reason why the activation rotational speed Cr is changed in accordance with the total sum of the flow rate coefficients Cva will be described.

As described above, when the air conditioner 1 performs the defrosting operation, the refrigerant circuit 100 has to be switched from a state of performing the heating operation to a state of performing the defrosting (cooling) operation. During switching, the compressor 21 is temporarily stopped, and the four-way valve 22 is switched. Then, the compressor 21 is activated again. When the four-way valve 22 is switched, ports on the indoor heat exchangers 51*a* to 51*c* sides of the indoor expansion valves 52*a* to 52*c*, which are coupled to the discharge side of the compressor 21 during the heating operation, are coupled to the suction side of the compressor 21. Accordingly, a pressure difference from each of the liquid pipe coupling portions 53*a* to 53*c* sides of the indoor expansion valves 52*a* to 52*c* is reduced.

The above-described pressure difference is increased as time elapses from the activation of the compressor 21. The refrigerant does not flow into the gas pipe 9 from the indoor units 5*a* to 5*c* until the pressure difference becomes equal to or more than a predetermined value. Accordingly, so-called pull-down, in which the refrigerant accumulated at a position near the suction side of the compressor 21 in the gas pipe 9 is suctioned into the compressor 21 during the activation of the compressor 21, an amount of the refrigerant accumulated in the gas pipe 9 is then temporarily reduced, and suction pressure of the compressor 21 is abruptly reduced, occurs.

During the defrosting operation, the outdoor heat exchanger 23 functions as the condenser. Accordingly, the high-temperature refrigerant that is discharged from the compressor 21 flows into the outdoor heat exchanger 23 and melts the frost formed thereon. The amount of the frost formation on the outdoor heat exchanger 23 is an amount of the frost formation that corresponds to size of the outdoor heat exchanger 23. As the size of the outdoor heat exchanger 23 is increased, the amount of the frost formation is also increased. Thus, in the case where the outdoor heat exchanger 23 is large, the further large amount of the high-temperature refrigerant has to flow through the outdoor heat exchanger 23 in comparison with a case where the outdoor heat exchanger 23 is small.

Meanwhile, as described above, the indoor expansion valves 52*a* to 52*c* that have the capacities (the flow rate coefficients) respectively corresponding to the sizes of the indoor heat exchangers 51*a* to 51*c* are respectively provided in the indoor heat exchangers 51*a* to 51*c* that function as the evaporators during the defrosting operation. As the sizes of the indoor heat exchangers 51*a* to 51*c* are reduced, the indoor expansion valves 52*a* to 52*c* with the smaller flow rate coefficients Cv are respectively used. Thus, in the case where the indoor heat exchangers 51*a* to 51*c* are small, the indoor expansion valves 52*a* to 52*c* with the smaller flow rate coefficients Cv are used in comparison with a case where the indoor heat exchangers 51*a* to 51*c* are large. Thus, the amount of the refrigerant that passes through the indoor expansion valves 52*a* to 52*c*, that is, the amount of the refrigerant that flows out from the indoor units 5*a* to 5*c* to the gas pipe 9 is reduced.

For what has been described so far, the refrigerant circulation amount in the refrigerant circuit 100 at the start of the defrosting operation depends on the total sum of the flow rate coefficients Cva that is the total sum of the flow rate coefficients Cv of the indoor expansion valves 52*a* to 52*c*. As the total sum of the flow rate coefficients Cva is reduced, the amount of the refrigerant that flows out from the indoor heat exchangers 51*a* to 51*c* is reduced with respect to the amount of the refrigerant that flows into the outdoor heat exchanger 23. Accordingly, the refrigerant is accumulated in the outdoor heat exchanger 23 or the liquid pipe 8, and the refrigerant circulation amount in the installation condition is reduced. Then, as the refrigerant circulation amount in the installation condition is reduced, the degree of the reduction in the suction pressure is increased.

In the case where the activation rotational speed Cr of the compressor 21 is increased (90 rps) and the compressor 21 is activated in order to start the defrosting operation in a state that the suction pressure is significantly reduced due to the total sum of the flow rate coefficients Cva, the suction pressure may be further reduced by the above-described pull-down, and fall below a performance lower limit value. When the suction pressure falls below the performance lower limit value, the compressor 21 may be damaged. Alternatively, low-pressure protection control for stopping the compressor 21 to prevent damage to the compressor 21 may be executed, and a defrosting operation time may be extended.

Thus, in the present invention, the total sum of the flow rate coefficients Cva is used as in the defrosting operation condition table 300*a* depicted in FIG. 2. In the case where the total sum of the flow rate coefficients Cva is lower than the threshold A, the activation rotational speed Cr of the compressor 21 is set at 60 rps, and the defrosting operation is performed while the suction pressure is prevented from being reduced and falling below the performance lower limit value. Then, in the case where the total sum of the flow rate coefficients Cva is equal to or more than the threshold A, the degree of the reduction in the suction pressure is small, and there is a small possibility that the suction pressure falls below the performance lower limit value. Accordingly, the activation rotational speed Cr of the compressor 21 is set at 90 rps so as to control such that the defrosting operation is terminated as early as possible.

Next, a reason why the defrosting operation interval Tm is changed in accordance with the total sum of the flow rate coefficients Cva will be described. Here, the defrosting operation interval Tm is an interval time in which a state that the defrosting operation start condition is not established during the heating operation continues. The defrosting operation interval Tm is defined to forcibly execute the defrosting operation at a time point that the defrosting operation interval Tm elapses from a time point at which the heating operation is restored.

As described above, in the case where the defrosting operation start condition is established, the amount of the frost formation on the outdoor heat exchanger 23 is in a level that interferes with the heating capacity. On the contrary, even in the case where the defrosting operation start condition is not established, the outdoor heat exchanger 23 may be frosted, and heat exchange efficiency in the outdoor heat exchanger 23 may be degraded, although the amount of the frost formation thereon is small in comparison with the case where the defrosting operation start condition is established. Thus, even though the amount of the frost formation is small, the frost is preferably removed from the outdoor heat exchanger 23. Accordingly, the above defrosting operation interval Tm is defined. Then, even in the case where the defrosting operation start condition is not established, the defrosting operation is performed at the time point at which the defrosting operation interval Tm elapses from a time point at which the last defrosting operation is terminated, so as to melt the frost generated on the outdoor heat exchanger 23.

By the way, capacity of melting the frost, which is formed on the outdoor heat exchanger 23, per unit time during the defrosting operation (hereinafter described as defrosting capacity) is increased as the rotational speed of the compressor 21 is increased. It is because the amount of the high-temperature high-pressure refrigerant that flows into the outdoor heat exchanger 23 is increased as the rotational speed of the compressor 21 is increased. As described above, in the present invention, in the case where the total sum of the flow rate coefficients Cva is lower than the threshold A, the defrosting operation is started by setting the activation rotational speed Cr at 60 rps. In this case, the defrosting capacity is lower than a case where the defrosting operation is started by setting the activation rotational speed Cr at 90 rps, and the defrosting operation time is extended in conjunction with this. Thus, when the amount of the frost formation on the outdoor heat exchanger 23 is the same, the defrosting operation time is longer in the case where the defrosting operation is started by setting the activation rotational speed Cr at 60 rps than in the case where the activation rotational speed Cr is set at 90 rps.

In consideration of what has been described so far, in the case where the total sum of the flow rate coefficients Cva is lower than the threshold A, that is, in the case where the defrosting operation is started by setting the activation rotational speed Cr at 60 rps, the defrosting operation is preferably performed before the amount of the frost formation on the outdoor heat exchanger 23 becomes large, so as to shorten the defrosting operation time as much as possible.

Thus, in the present invention, as in the defrosting operation condition table 300*a* depicted in FIG. 2, in the case where the total sum of the flow rate coefficients Cva is lower than the threshold A, the defrosting operation interval Tm is set to 90 min, and the defrosting operation is performed before the amount of the frost formation on the outdoor heat exchanger 23 becomes large. Accordingly, compared to a case where the defrosting operation interval Tm is set to 180 min, frequency of switching to the defrosting operation is increased. However, by the start of the defrosting operation before the amount of the frost formation thereon becomes large, the defrosting operation is terminated as early as possible. Accordingly, a sense of comfort of the user during the heating operation is not hindered.

Next, a description will be made on control in the air conditioner 1 of this embodiment at a time that the defrosting operation is performed by using FIGS. 1 to 3. FIG. 3 depicts a flow of process executed by the CPU 210 of the outdoor unit control means 200 in the case where the air conditioner 1 performs the defrosting operation. In FIG. 3, ST indicates a step, and a numeral following this indicates a step number. It should be noted that, in FIG. 3, the description will be centered on the process related to the present invention, and the process other than this, for example, a general process related to the air conditioner, such as control of the refrigerant circuit that corresponds to operation conditions including a set temperature, an air volume, and the like instructed by the user will not be described.

In the initial setting during the installation, the air conditioner 1 stores the flow rate coefficient Cv of each of the indoor expansion valves 52*a* to 52*c*, which is input from the installation information input unit 250, in the storage unit 220. At this time, the CPU 210 calculates the total sum of the flow rate coefficients Cva by adding the stored flow rate coefficient Cv of each of the indoor expansion valves 52*a* to 52*c*. Then, the CPU 210 refers to the defrosting operation condition table 300*a* stored in the storage unit 220, and extracts and stores the activation rotational speed Cr and the defrosting operation interval Tm, which correspond to the calculated total sum of the flow rate coefficients Cva, in the storage unit 220.

When the air conditioner 1 is performing the heating operation, the CPU 210 determines whether the defrosting operation start condition has been established (ST1). As described above, the defrosting operation start condition is, for example, the case where the state that the refrigerant temperature detected by the heat exchange temperature sensor 35 is lower by 5° C. or more than the ambient air temperature detected by the ambient air temperature sensor 36 continues for 10 minutes or longer after the lapse of 30 minutes of the heating operation time. The CPU 210 receives the refrigerant temperature detected by the heat exchange temperature sensor 35 and the ambient air temperature detected by the ambient air temperature sensor 36, so as to determine whether the above condition has been established.

If the defrosting operation start condition has not been established in ST1 (ST1—No), the CPU 210 reads out the defrosting operation interval Tm stored in the storage unit 220, and determines whether duration Ts of the heating operation is shorter than the defrosting operation interval Tm (ST12). If the duration Ts of the heating operation is not shorter than the defrosting operation interval Tm (ST12—No), the CPU 210 proceeds with the process to ST3. If the duration Ts of the heating operation is shorter than the defrosting operation interval Tm (ST12—Yes), the CPU 210 continues the heating operation (ST13), and returns the process to ST1.

If the defrosting operation start condition has been established in ST1 (ST1—Yes), the CPU 210 determines whether the duration Ts of the heating operation is equal to or more than a heating mask time Th (ST2). Here, the heating mask time Th is a time in which, even when the defrosting operation start condition is established again after the heating operation is restored from the defrosting operation, the operation is not switched to the defrosting operation but the heating operation is continued. The heating mask time Th is provided to prevent the sense of comfort of the user from being hindered by frequent switching to the defrosting operation during the heating operation. This heating mask time is set to 40 minutes, for example.

If the duration Ts of the heating operation is not equal to or more than the heating mask time Th (ST2—No) in ST2, the CPU 210 proceeds with the process to ST13, continues the heating operation, and returns the process to ST1. If the duration Ts of the heating operation is equal to or more than the heating mask time Th (ST2—Yes), the CPU 210 proceeds with the process to ST3.

In ST3, the CPU 210 executes a defrosting operation preparation process. In the defrosting operation preparation process, the CPU 210 stops the compressor 21 and the outdoor fan 27 and switches the four-way valve 22 such that the ports a and b communicate with each other and that the ports c and d communicate with each other. Thus, the refrigerant circuit 100 is brought into a state that the outdoor heat exchanger 23 functions as the condenser and the indoor heat exchangers 51*a* to 51*c* function as the evaporators, that is, the state at the time that the cooling operation is performed, which is depicted in FIG. 1(A). It should be noted that the CPUs 510*a* to 510*c* of the indoor units 5*a* to 5*c* respectively stop the indoor fans 55*a* to 55*c* during the defrosting operation.

Next, the CPU 210 starts timer measurement (ST4), and activates the compressor 21 at the activation rotational speed Cr stored in the storage unit 220 (ST5). The defrosting operation is started in the air conditioner 1 by activating the compressor 21. It should be noted that, although not depicted, the CPU 210 includes a timer measurement unit.

Next, the CPU 210 determines whether one minute has elapsed since the timer measurement is started at ST5, that is, since the compressor 21 is activated (ST6). If one minute has not elapsed (ST6—No), the CPU 210 returns the process to ST6. If one minute has elapsed (ST6—Yes), the CPU 210 resets the timer (ST7).

The above-described process from ST4 to ST7 is executed to maintain the rotational speed of the compressor 21 at the activation rotational speed Cr and drive the compressor 21 for one minute from the activation of the compressor 21. As described above, the activation rotational speed Cr is defined in accordance with the total sum of the flow rate coefficients Cva. When the compressor 21 is activated at the activation rotational speed Cr at the start of the defrosting operation, the reduction in the suction pressure, which is caused by the pull-down, can be suppressed. This pull-down is eliminated when the pressure difference between both of the ports of each of the indoor expansion valves 52*a* to 52*c* becomes equal to or more than the predetermined value and the refrigerant flows into the gas pipe 9 from the indoor units 5*a* to 5*c*. A predetermined time is required from the activation of the compressor 21 in order to make the pressure difference between both of the ports of each of the indoor expansion valves 52*a* to 52*c* equal to or more than the predetermined value. Thus, the rotational speed of the compressor 21 is desirably not changed but is maintained at the activation rotational speed Cr for this predetermined time. It should be noted that the above predetermined time is defined in advance by an experiment or the like.

The CPU 210 that has reset the timer in ST7 sets the rotational speed of the compressor 21 at a predetermined rotational speed (for example, 90 rps) (ST8). This predetermined rotational speed is obtained in advance by a test or the like and is stored in the storage unit 220.

Next, the CPU 210 determines whether the defrosting operation termination condition has been established (ST9). As described above, the defrosting operation termination condition is, for example, whether the temperature of the refrigerant detected by the heat exchange temperature sensor 35, the refrigerant flowing out from the outdoor heat exchanger 23, has become equal to or more than 10° C. The CPU 210 constantly receives and stores the refrigerant temperature that is detected by the heat exchange temperature sensor 35, in the storage unit 220. The CPU 210 refers to the stored refrigerant temperature and determines whether this has become equal to or more than 10° C., that is, the defrosting operation termination condition has been established. It should be noted that the defrosting operation termination condition is defined in advance by a test or the like and is a condition that it is considered that the frost generated on the outdoor heat exchanger 23 has been melted.

If the defrosting operation termination condition has not been established in ST9 (ST9—No), the CPU 210 returns the process to ST8 and continues the defrosting operation. If the defrosting operation termination condition has been established (ST9—Yes), the CPU 210 executes a heating operation restart process (ST10). In the operation restart process, the CPU 210 stops the compressor 21 and switches the four-way valve 22 such that the ports a and d communicate with each other and the ports b and c communicate with each other. Thus, the refrigerant circuit 100 is brought into a state that the outdoor heat exchanger 23 functions as the evaporator and the indoor heat exchangers 51*a* to 51*c* function as the condensers.

Then, the CPU 210 restarts the heating operation (ST11) and returns the process to ST1. In the heating operation, the CPU 210 controls the rotational speeds of the compressor 21 and the outdoor fan 27 as well as the opening degree of the outdoor expansion valve 24 in accordance with the heating capacity that is requested from the indoor units 5*a* to 5*c*.

EXAMPLE 2

Next, a description will be made on a second embodiment of the air conditioner of the present invention by using FIG. 4. It should be noted that, since the configuration and the operation performance of the air conditioner and changing of the activation rotational speed of the compressor and the defrosting operation interval in the defrosting operation in accordance with the total sum of the flow rate coefficients Cva are the same as those in the first embodiment, the detailed description thereon will not be made in this embodiment. What differs from the first embodiment is that the activation rotational speed of the compressor and the defrosting operation interval are defined in consideration of a length of the refrigerant pipe for coupling the outdoor unit and the indoor units in addition to the total sum of the flow rate coefficients Cva in a defrosting operation condition table.

Similar to the defrosting operation condition table 300*a* depicted in FIG. 2, a defrosting operation condition table 300*b* that is depicted in FIG. 4 is stored in advance in the storage unit 220 of the outdoor unit control means 200. The defrosting operation condition table 300*c* defines the activation rotational speed Cr of the compressor 21 and the defrosting operation interval Tm at the time that the air conditioner 1 starts the defrosting operation in accordance with the total sum of the flow rate coefficients Cva and a refrigerant pipe length Lr.

Here, the refrigerant pipe length Lr indicates lengths of the liquid pipe 8 and the gas pipe 9 (unit: m). In this embodiment, a description will be made with a maximum value of the refrigerant pipe length Lr being 50 m. This refrigerant pipe length Lr is determined in accordance with size of a building where the air conditioner 1 is installed and distances from an installation position of the outdoor unit 2 to rooms where the indoor units 5*a* to 5*c* are installed. It should be noted that, similar to the flow rate coefficient Cv of each of the indoor expansion valves 52*a* to 52*c* described in the first embodiment, the refrigerant pipe length Lr is input from the installation information input unit 250 in the initial setting during the installation of the air conditioner 1.

As depicted in FIG. 4, in the defrosting operation condition table 300*b*, the activation rotational speed Cr and the defrosting operation interval Tm in the case where the refrigerant pipe length Lr is shorter than a predetermined threshold pipe length B (for example, 40 m), and the activation rotational speed Cr and the defrosting operation interval Tm in the case where the refrigerant pipe length Lr is equal to or more than the threshold pipe length B are defined for each of the case where the total sum of the flow rate coefficients Cva is lower than the predetermined threshold A (for example, 0.4) and the case where the total sum of the flow rate coefficients Cva is equal to or more than the threshold A (these are the same as those in the defrosting operation condition table 300*a*).

More specifically, in the case where the total sum of the flow rate coefficients Cva is lower than the threshold A and the refrigerant pipe length Lr is equal to or more than the threshold pipe length B, the activation rotational speed Cr is set at 50 rps, and the defrosting operation interval Tm is set to 70 min. In the case where the total sum of the flow rate coefficients Cva is lower than the threshold A and the refrigerant pipe length Lr is shorter than the threshold pipe length B, the activation rotational speed Cr is set at 60 rps, and the defrosting operation interval Tm is set to 90 min. In addition, in the case where the total sum of the flow rate coefficients Cva is equal to or more than the threshold A and the refrigerant pipe length Lr is equal to or more than the threshold pipe length B, the activation rotational speed Cr is set at 80 rps, and the defrosting operation interval Tm is set to 120 min. In the case where the total sum of the flow rate coefficients Cva is equal to or more than the threshold A and the refrigerant pipe length Lr is shorter than the threshold pipe length B, the activation rotational speed Cr is set at 90 rps, and the defrosting operation interval Tm is set to 180 min. It should be noted that the threshold A, the threshold pipe length B, the activation rotational speed Cr, and the defrosting operation interval Tm, which are shown in FIG.

4, are numerical values that are defined in advance by a test or the like, and numerical values that are inherent to the air conditioner 1.

Next, a description will be made on a reason why the activation rotational speed Cr of the compressor 21 and the defrosting operation interval Tm are defined in accordance with the total sum of the flow rate coefficients Cva and the refrigerant pipe length Lr in the defrosting operation condition table 300*b*. As described in the first embodiment, the pressure difference between each of the liquid pipe coupling portions 53*a* to 53*c* sides (the high-pressure side) and each of the indoor heat exchangers 51*a* to 51*c* sides (the low-pressure side) in the indoor expansion valves 52*a* to 52*c* is hardly present at the start of the defrosting operation. Accordingly, the pull-down, in which the refrigerant does not flow into the gas pipe 9 from the indoor units 5*a* to 5*c*, the amount of the refrigerant accumulated in the gas pipe 9 is then temporarily reduced, and the suction pressure of the compressor 21 is abruptly reduced, occurs.

The degree of the reduction in the suction pressure at a time that the pull-down occurs is increased as the refrigerant pipe length Lr is increased. A reason for the above is as follows. That is, as the liquid pipe 8 is extended, the pressure on each of the coupling portions 53*a* to 53*c* sides of the indoor expansion valves 52*a* to 52*c* is less likely to be increased due to pressure loss in the liquid pipe 8. Accordingly, the pressure difference is not produced in the indoor expansion valves 52*a* to 52*c*. Thus, a time required for the refrigerant that flows into the gas pipe 9 from the indoor units 5*a* to 5*c* to be suctioned into the compressor 21 is extended.

Thus, in the case where the total sum of the flow rate coefficients Cva is small and the refrigerant pipe length Lr is long, a possibility that the suction pressure falls below the performance lower limit value is increased in comparison with a case where the refrigerant pipe length Lr is short. Similarly, also in the case where the total sum of the flow rate coefficients Cva is large and the refrigerant pipe length Lr is long, the possibility that the suction pressure falls below the performance lower limit value is increased in comparison with the case where the refrigerant pipe length Lr is short.

In this embodiment, in consideration of the problem described above, the defrosting operation condition table 300*b* that defines the activation rotational speed Cr of the compressor 21 in accordance with the total sum of the flow rate coefficients Cva and the refrigerant pipe length Lr is included, and the activation rotational speed Cr of the compressor 21 is determined based on this defrosting operation condition table 300*b*. The activation rotational speed Cr is set finely in accordance with the total sum of the flow rate coefficients Cva and the refrigerant pipe length Lr. Thus, while the reduction in the low pressure during the defrosting operation is being further reliably prevented, the degradation of the efficiency of the defrosting operation, which is caused by unnecessarily reducing the activation rotational speed Cr of the compressor 21, can be prevented.

It should be noted that, similar to the first embodiment, the defrosting operation interval Tm is defined in accordance with the activation rotational speed Cr of the compressor 21. Since the effect obtained by changing the defrosting operation interval Tm in accordance with the activation rotational speed Cr of the compressor 21 is also similar to that in the first embodiment, the description thereon will not be made.

As described above, the air conditioner of the present invention drives the compressor at the activation rotational speed in accordance with the flow rate coefficient or the activation rotational speed in accordance with the flow rate coefficient and the refrigerant pipe length for the predetermined time from the start of the defrosting operation. Accordingly, even in the case where the refrigerant circulation amount at the start of the defrosting operation is reduced due to the small total sum of the capacity of the flow rate adjustment valve, it is possible to prevent the suction pressure from being significantly reduced so as to fall below performance lower limit pressure of the compressor. Thus, the damage to the compressor can be prevented. In addition, it is possible to prevent a case where the suction pressure falls below the performance lower limit suction pressure of the compressor and thus the low-pressure protection control is executed. Therefore, a case where the defrosting operation is interrupted by the low-pressure protection control, the defrosting operation time is extended, and the restoration of the heating operation is delayed does not occur.

In the embodiment that has been described so far, the description has been made on a case where a worker operates the installation information input unit 250 and manually inputs the flow rate coefficient Cv of each of the indoor expansion valves 52*a* to 52*c* during the installation of the air conditioner. However, the present invention is not limited thereto. For example, the flow rate coefficients Cv of the indoor expansion valves 52*a* to 52*c* may respectively be included in model information on the indoor units 5*a* to 5*c* that is stored in the storage units 520*a* to 520*c* of the indoor unit control units means 500*a* to 500*c*. The flow rate coefficient Cv of each of the indoor expansion valves 52*a* to 52*c* may be obtained when the CPU 210 of the outdoor unit 2 receives the model information from the indoor units 5*a* to 5*c*. Here, the model information is configured by including basic information of the indoor units 5*a* to 5*c*, such as the rated capacity, model names, and identification numbers of the indoor units 5*a* to 5*c*, in addition to the flow rate coefficient Cv of each of the indoor expansion valves 52*a* to 52*c*.

In addition, the description has been made on a case where the flow rate coefficient Cv is used as that representing the capacity of each of the indoor expansion valves 52*a* to 52*c*. However, the present invention is not limited thereto. A Kv value or an Av value which is obtained by changing the pressure difference between both of the ports of each of the indoor expansion valves 52*a* to 52*c* or the state of the fluid flowing through each of the indoor expansion valves 52*a* to 52*c* from the value used for calculating the flow rate coefficient Cv may be used. Furthermore, an efficient cross section of each of the indoor expansion valves 52*a* to 52*c* may be used.

In addition, instead of being input by the worker who operates the installation information input unit 250, the refrigerant pipe length Lr may be calculated by the CPU 210 of the outdoor unit 2 as will be described below. A relational expression between an operation state amount, such as a supercooling degree at the refrigerant outlet in the case where the outdoor heat exchanger 23 functions as the condenser and a low-pressure saturation temperature that is obtained by using the suction pressure detected by the low-pressure sensor 32, and the refrigerant pipe length Lr (for example, a table that defines the refrigerant pipe length Lr in accordance with a supercooling degree) is stored in the storage unit 220 of the outdoor unit control means 200. The CPU 210 obtains the operation state amount at a time that the air conditioner 1 performs the cooling operation, so as to obtain the refrigerant pipe length Lr by using the above expression.

DESCRIPTION OF REFERENCE SIGNS

1 Air conditioner
2 Outdoor unit
5*a* to 5*c* Indoor unit
8 Liquid pipe
9 Gas pipe
21 Compressor
23 Outdoor heat exchanger
32 Low-pressure sensor
35 Heat exchange temperature sensor
36 Ambient air temperature sensor
51*a* to 51*c* Indoor heat exchanger
52*a* to 52*c* Indoor expansion valve
100 Refrigerant circuit
200 Outdoor unit control unitmeans
210 CPU
220 Storage unit
240 Sensor input unit
250 Installation information input unit
300*a, b* Defrosting operation condition table
Cv Total sum of flow rate coefficient of indoor expansion valve
Lr Refrigerant pipe length
Cr Activation rotational speed
Tm Defrosting operation interval

The invention claimed is:

1. An air conditioner comprising:

at least one outdoor unit having a compressor, a flow passage switching unit, an outdoor heat exchanger, and an outdoor unit controller;

at least one indoor unit having an indoor heat exchanger and a flow rate adjustment valve;

at least one liquid pipe and at least one gas pipe for coupling the outdoor unit and the indoor unit, wherein the outdoor unit controller drives the compressor at an activation rotational speed as a predetermined value for a predetermined time from a start of a defrosting operation, and plural values are defined as the activation rotational speed in accordance with a total sum of a capacity of the flow rate adjustment valve.

2. The air conditioner according to claim 1, wherein in a case where the total sum of the capacity of the flow rate adjustment valve is lower than a predetermined threshold, the activation rotational speed is defined to be low in comparison with a case where the total sum of the capacity of the flow rate adjustment valve is equal to or more than the predetermined threshold.

3. An air conditioner comprising:

at least one outdoor unit having a compressor, a flow passage switching unit, an outdoor heat exchanger, and an outdoor unit controller;

at least one indoor unit having an indoor heat exchanger and a flow rate adjustment valve;

at least one liquid pipe and at least one gas pipe for coupling the outdoor unit and the indoor unit, wherein the outdoor unit controller drives the compressor at an activation rotational speed as a predetermined value for a predetermined time from a start of a defrosting operation, and plural values are defined as the activation rotational speed in accordance with a total sum of a capacity of the flow rate adjustment valve and a refrigerant pipe length that is lengths of the liquid pipe and the gas pipe.

4. The air conditioner according to claim 3, wherein in a case where the refrigerant pipe length is equal to or more than a predetermined threshold pipe length, the activation rotational speed is defined to be low in comparison with a case where the refrigerant pipe length is shorter than the predetermined threshold pipe length.

* * * * *